US006192536B1

(12) United States Patent
Connors

(10) Patent No.: US 6,192,536 B1
(45) Date of Patent: Feb. 27, 2001

(54) WIND RESISTANT BEACH TOWEL

(76) Inventor: Tina Marie Connors, 1703 Certainty Dr., Point Pleasant, NJ (US) 08743

( * ) Notice: Subject to any disclaimer, the term of this patent is extended or adjusted under 35 U.S.C. 154(b) by 0 days.

(21) Appl. No.: 09/470,465

(22) Filed: Dec. 22, 1999

(51) Int. Cl.[7] ..... A47G 9/06
(52) U.S. Cl. ..... 5/417; 5/419; 5/656; 383/4
(58) Field of Search ..... 5/417, 419, 420, 5/656, 485; 52/3; 383/4

(56) References Cited

U.S. PATENT DOCUMENTS

| | | | | |
|---|---|---|---|---|
| 3,226,737 | | 1/1966 | Rote . | |
| 4,278,719 | * | 7/1981 | Sarnecki | 5/417 |
| 4,634,618 | | 1/1987 | Greer et al. . | |
| 4,659,906 | | 4/1987 | Roberts . | |
| 5,018,229 | | 5/1991 | Eberhart . | |
| 5,072,467 | * | 12/1991 | Hunt | 5/417 |
| 5,406,659 | * | 4/1995 | Camp | 5/417 |
| 5,443,880 | | 8/1995 | Wike . | |
| 5,499,411 | | 3/1996 | Wong . | |
| 5,644,807 | | 7/1997 | Battistella . | |
| 5,729,846 | * | 3/1998 | Sullivan | 5/419 |
| 5,774,912 | * | 7/1998 | Dominique | 5/417 |

* cited by examiner

*Primary Examiner*—Michael F. Trettel
(74) *Attorney, Agent, or Firm*—Baker Botts L.L.P.

(57) ABSTRACT

A beach towel made of ordinary, machine washable fabric, together with a plurality of pockets, which may be filled with sand or other material to weigh down the towel is provided. The towel may be attached to another wind resistant beach towel to provide for a blanket cover which will not be blown off by wind. In addition, the towel may be attached to another wind resistant beach towel to cover a greater area.

11 Claims, 3 Drawing Sheets

WIND RESISTANT BEACH TOWEL

FIELD OF THE INVENTION

The invention relates generally to towels, blankets and similar products that are used at a beach and more particularly to beach products which are able to maintain utility under less than optimum atmospheric conditions.

BACKGROUND OF THE INVENTION

It has been recognized that standard bath towels and blankets are not well suited for use at the beach or other outdoor forums. Wind and other variable atmospheric conditions often cause such household items to move or blow away. Transporting the towels or blanket to the beach and, more importantly, from the beach after the towel has become damp requires use of a bag or tote which must be inconveniently stored while the user is attempting to relax at the beach. For these and other reasons, there have been several attempts to provide a beach towel which is optimized for outdoor use at a distant forum.

In U.S. Pat. No. 3,226,737, to Rote, a Beach and Picnic blanket with detachable triangular pockets at each corner made of flexible material is disclosed. The pockets are constructed to contain material such as sand, a weighted bag, or stones.

In U.S. Pat. No. 4,634,618, to Greer et al., a weighted towel using a hidden weighted cord sewn into the perimeter of the towel is disclosed. Greer et al. also disclosed a storage pouch attached to a top end of the towel for storing the towel.

In U.S. Pat. No. 4,654,906, to Roberts, a towel with closeable pockets at each corner for containing sand is disclosed. The pockets may be lined with a waterproof layer such as plastic to keep the sand dry even if water comes in contact with the blanket.

In U.S. Pat. No. 5,018,229, to Eberhart, a beach towel with pockets at the corners and a weight in a sealed package for each pocket is disclosed. Each pocket serves as a receptacle for personal effects and valuables by including a closeable opening that simulates a permanent closure.

In U.S. Pat. No. 5,443,880, to Wike, a beach towel with pockets for holding articles is disclosed, the pockets have integral closures and may be lined with waterproof or water-repellant material.

In U.S. Pat. No. 5,449,411, to Wong, a beach blanket with pockets is disclosed. The pockets are designed for holding sand without closures.

In U.S. Pat. No. 5,644,807, to Battistella, a beach blanket with a detachable pillow and carrying case having pockets is disclosed. The towel is a highly absorbent fabric with an inflatable pillow attached to the towel by means of a hook and loop type fastener. The inflatable pillow may be manufactured of vinyl with welded seams which prevent air leakage after inflation. One edge of the pillow is provided with a series of a storage compartments for small items to be carried, the small storage compartments being fastened by means of a hook and loop type fastener. The beach towel with pillow may be rolled up and bound by the binding cords attached to one lateral edge of the beach towel.

Unfortunately, none of the foregoing attempts provide a towel or blanket specifically optimized for use at the beach, since each requires the user to purchase a separate carrying case to transport the towel. Accordingly, there exists a need in the art for a towel or blanket which is optimized for use at the beach.

SUMMARY OF THE INVENTION

It is an object of the present invention to provide a towel or blanket which is optimized for the beach. Accordingly, the towel should resist being blown away by wind, pack easily into a self contained pocket, shed sand from its bottom surface when picked up so as not to annoy other beach-goers, and have pockets for storage of small items necessary for a nice day at the beach.

In order to meet these and other objects which will become apparent for reference to the disclosure set forth below, the present invention provides a beach towel, together with a plurality of corner pockets, a pillow attached to the towel which doubles as a carrying case, and a plurality of fixtures around the perimeter of the towel for the attachment of additional towels. On a bottom side of the blanket, a second material, may be adhered to the fabric of the towel so that sand falls off the towel or may be easily knocked off without undue shaking of the towel which may irritate other beach-goers on a windy day.

In a preferred arrangement, each pocket may be filled with sand, personal effects or other material to weigh down the towel. Each pocket has a means for closure at its opening to prevent the contents of the pocket from becoming emptied unintentionally. Thus, when the pockets are filled, the towel is held down by the weight of the pockets and thus resistant to being lifted by wind. The pockets may comprise two chambers: one chamber for containing sand or other weighted material, with an opening which faces away from the center of the blanket; and a second chamber for containing personal effects such as keys or money, with an opening facing toward the center of the blanket. The chambers may be made of waterproof material to prevent personal items such as money or wallets from becoming damaged, as well as preventing sand used to weight the blanket from becoming wet and therefore difficult to empty.

Advantageously, the invention includes a middle pocket which may be used as a pillow, or may be reversed inside out for packing the towel within. The middle pocket may be detachable or fixed to one edge of the towel. The opening of the middle pocket may be closed with Velcro, a hook and loop fastener by a drawstring which may also be used as a strap for carrying the towel when attached to a loop at an inside corner of the middle pocket.

In an especially preferred arrangement, the fasteners along the perimeter of the towel are provided for connecting a second wind resistant beach towel on top of a first wind resistant beach towel so that the second towel may act as a blanket. In addition, these fasteners allow one wind resistant beach towel to be attached to another so that adjoined towels may cover a larger area.

The accompanying drawings, which are incorporated and constitute part of the disclosure herein, illustrate preferred embodiments of the invention and serve to explain the principles of the invention.

BRIEF DESCRIPTION OF THE DRAWINGS

Throughout the figures, the same reference numerals and characters, unless otherwise stated, are used to denote like features, elements, components or portions of the illustrated embodiments.

DETAILED DESCRIPTION OF THE PREFERRED EMBODIMENTS

Figure 1:
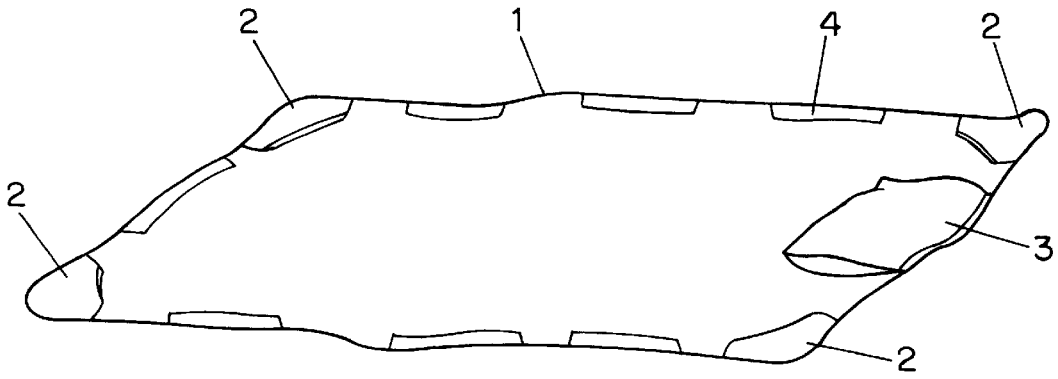
FIG. 1 is a perspective view of embodiment of the present invention.
Figure 2:
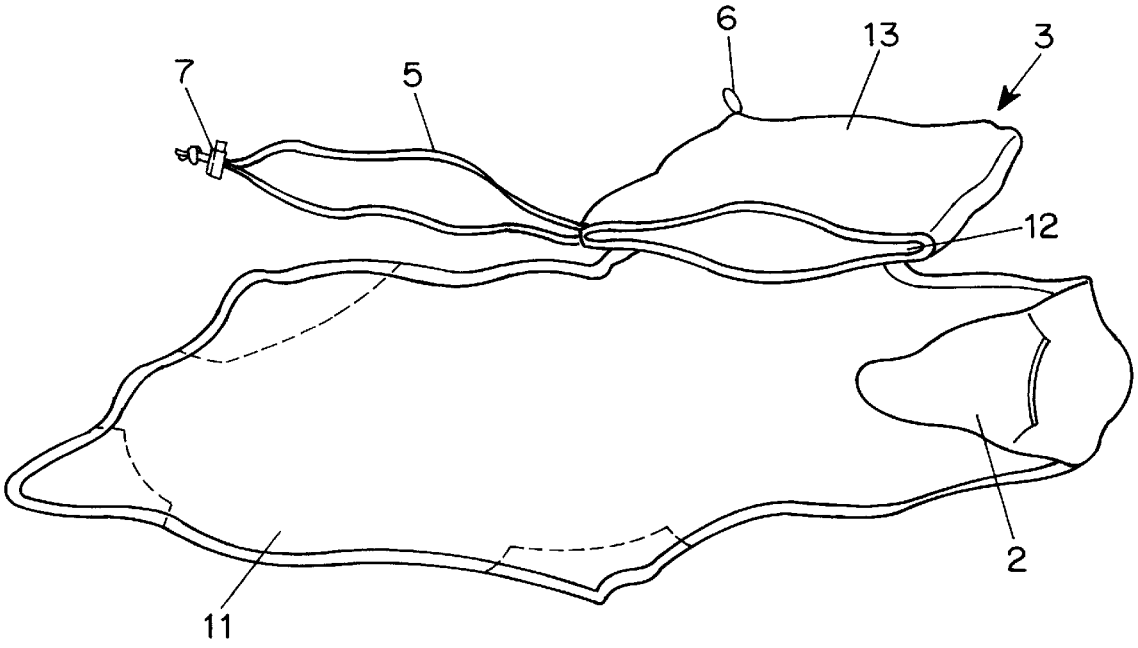
FIG. 2 is a perspective view of a side of the embodiment of FIG. 1, showing a middle pocket inside-out.

Referring to FIGS. 1 and 2, an exemplary embodiment of the present invention will now be described. A towel 1, with pockets 2, 3, may be made of soft, adsorbant fabric, preferably an adsorbant cotton blend or terry cloth. On a bottom side of the towel, a second material 11, may be adhered to the fabric of the towel by conventional means which resist separation after multiple washings of the towel, such as stitching or glue. The second material 11 comprises a rugged, lightweight fabric which resists the adhering of sand, such as nylon. The towel 1 can be a roughly rectangular shape and may be of several sizes, but preferably large enough to accommodate the average sized beach-goer. The pockets 2 are preferably four in number and can be adhered to the corners of the towel by conventional means which resist separation after multiple washings of the towel, such as stitching or glue. The pockets 2 may be of any shape, but are preferably triangular and of a size to accommodate small items such as keys, wallets, sunscreen, and sunglasses. Preferably, each side of the pockets 2 should be from eight (8) to twelve (12) inches in length. The pockets should lie flat against the towel when empty. In addition, strips of Velcro 4 or other suitable fastener are preferably attached along the perimeter of the towel 1.

The invention includes a middle pocket 3 which may be made of two materials: a soft material 12 on an interior side of the middle pocket 3 which becomes an outside surface of the middle pocket 3 when it is reversed and used as a pillow; and a rugged, tear-resistant material 13 on the outside of the middle pocket to provide a sturdy constriction for when the middle pocket 3 is used as a carrying case. The soft material is preferably an easily cleaned soft cotton material.

The rugged, tear-resistant material is preferably denim or canvas and can be made waterproof. Thus, when the towel is unfolded, the middle pocket may be filled with sand or with clothing to thereby provide a pillow. The middle pocket 3 is preferably made into a rectangular shape and preferably at least as large as sufficient to accommodate the towel 1 when folded, as well a number of small items which may be in the pockets 2. Preferably, the middle pocket can be about fourteen (14) inches by twenty-four (24) inches.

Figure 3:
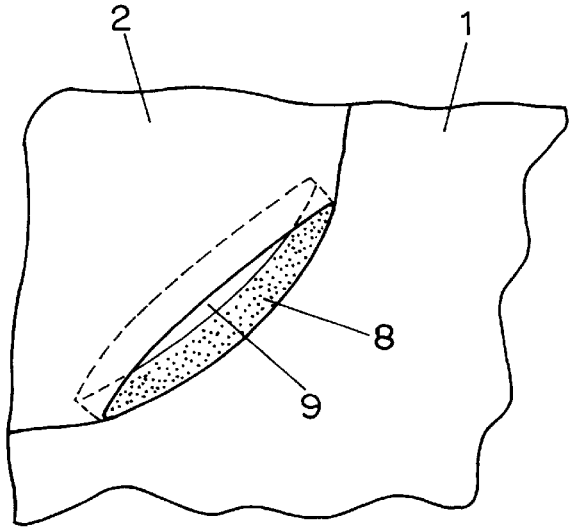
FIG. 3 is a top view of a corner of the embodiment of FIG. 1 showing a preferred arrangement of a pocket.
Figure 3A:
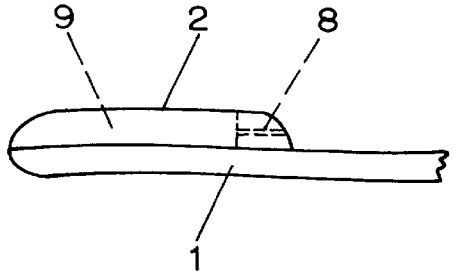
FIG. 3A is a side view of the comer shown in FIG. 3.
Figure 4:
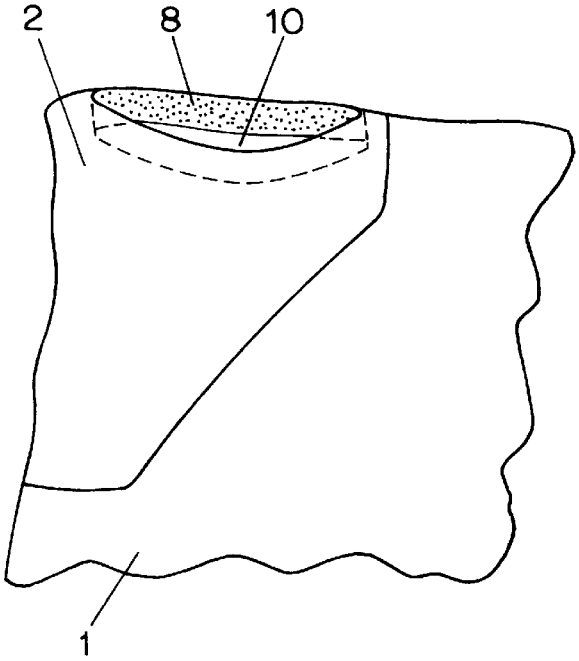
FIG. 4 is a top view of a corner of the embodiment of FIG. 1.
Figure 4A:
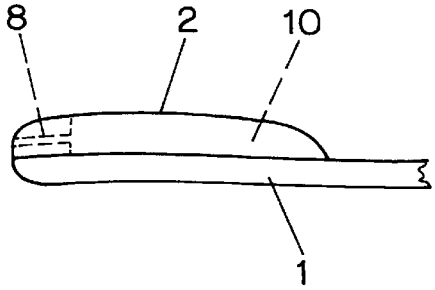
FIG. 4A is a side view of the corner showing FIG. 4.
Figure 5:
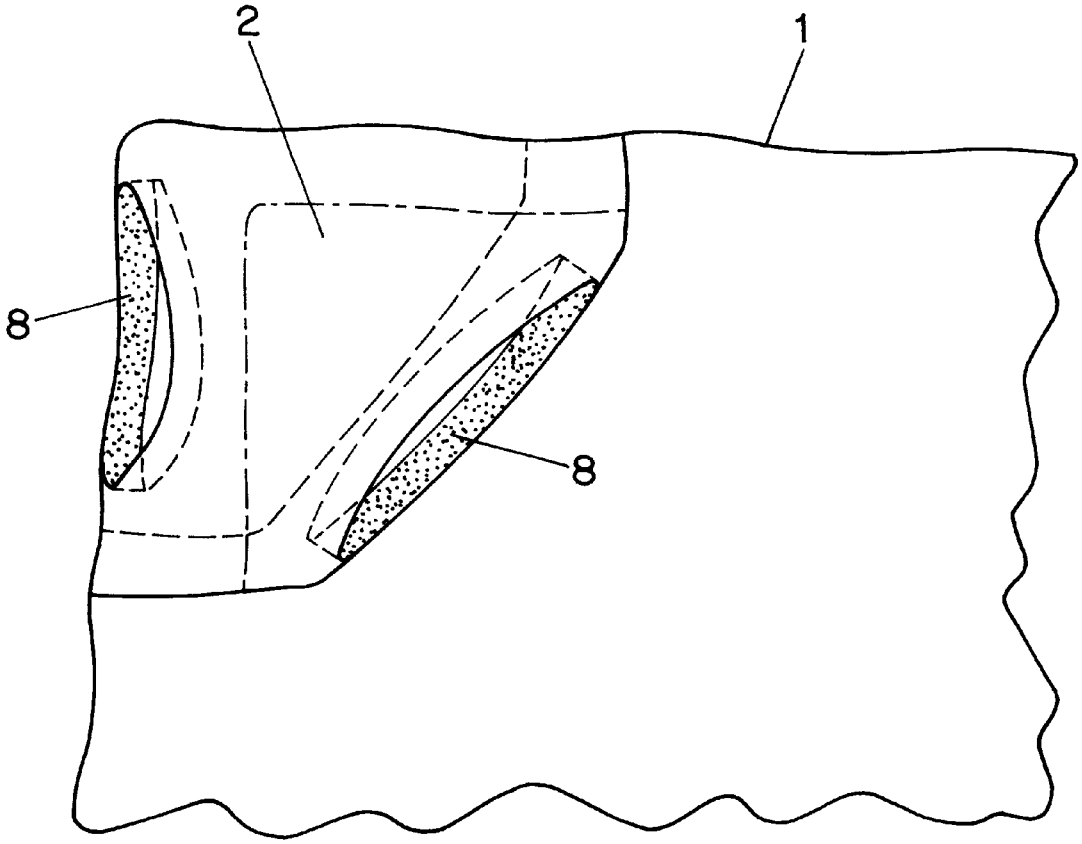
FIG. 5 is a top view of a comer of the embodiment of FIG. 1 showing a preferred arrangement of a pocket.
Figure 5A:
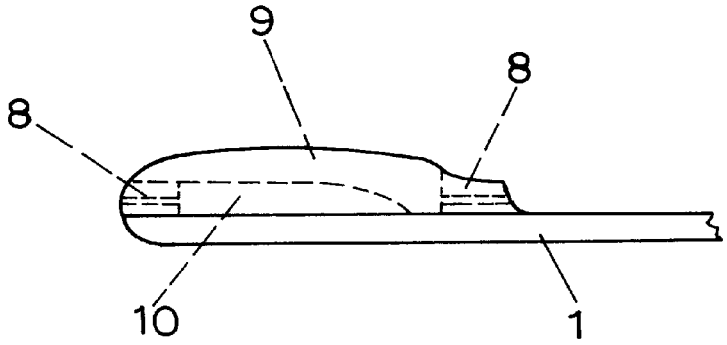
FIG. 5A is a side view of the corner shown in FIG. 5.

With reference to FIGS. 3 and 4, each of the four corners of the towel 1 includes a pocket 2 having an opening 8. The four pockets can be made of or merely lined with machine washable, waterproof material such as lycra. As best shown in FIG. 4 the pockets 2 may comprise two chambers: one first chamber 10 for containing sand or other weighted material, with an opening 8 which faces away from the center of the blanket; and, as shown in FIG. 3, a second chamber 9 for containing personal effects such as keys or money, with an opening 8 facing toward the center of the blanket. As shown in FIG. 5, The chambers 9, 10 are preferably of the same size and shape and can overlap. The openings 8 of each chamber may be sealed with opposing velcro strips or any other suitable fastener to effect a closure of the pocket.

The middle pocket 3 is attached in the middle of one side of the towel 1 to act as a pillow when the towel is in use, and to provide a carrying case when the towel is to be stored or carried. The middle pocket 3 may be attached by Velcro to the top of the towel or prefereably fixed to the middle of a side of the towel by connection to an edge of the opening of the middle pocket. The opening of the middle pocket may be closed by Velcro or preferably by a drawstring 5 and a cinch 7. The drawstring 5 is designed to be connected to at least one connector 6 attached to at least one outside corner of the middle pocket 3 for attaching the drawstring to create a single or double strap for easy carrying of the middle pocket. The connector may be a loop to which the drawstring may be tied or a hook fastener.

While the subject invention has been described in detail with reference to the figures, it is done so in connection with the illustrative embodiments. It is intended that changes and modifications can be made to the described embodiments without departing from the true scope and spirit of the subject invention as defined by the appended claims.

I claim:

1. A wind resistant beach towel comprising:

a towel;

a sand resistant bottom material affixed to a face of said towel;

at least one corner pocket affixed to said face at a corner of said towel, said corner pocket having a first chamber and a second chamber, said first chamber having a first opening at an edge portion of said towel and including means for closing said first opening and said second chamber overlapping said first chamber and having a second opening facing a center portion of said towel and including means for closing said second opening; and a middle pocket having an opening therein and being affixed to a middle portion of an edge of said towel to thereby provide self-storage for said beach towel.

2. The wind resistant towel in claim 1, further comprising:

a drawstring attached to a perimeter of said opening of said middle pocket for effecting closing thereof.

3. The wind resistant towel in claim 1, further comprising a plurality of fasteners mechanically attached along different portions of said perimeter of said towel.

4. The wind resistant towel in claim 3, wherein said fasteners comprise at least one hook and loop fastener.

5. The wind resistant towel in claim 1, wherein said bottom material comprises nylon.

6. The wind resistant towel in claim 1, wherein said at least one corner pocket further comprises a substantially waterproof lining.

7. The wind resistant towel in claim 1, wherein said middle pocket includes an interior cotton portion attached to an edge portion of said towel and an exterior denim portion.

8. The wind resistant towel in claim 1, wherein said means for closing said first opening comprises a zipper.

9. The wind resistant towel in claim 1, wherein said means for closing said first opening comprises at least one hook and loop fastener.

10. The wind resistant towel in claim 1, wherein said means for closing said second opening comprises a zipper.

11. The wind resistant towel in claim 1, wherein said means for closing said second opening comprises at least one hook and loop fastener.

* * * * *